US011030896B2

(12) United States Patent
Lee et al.

(10) Patent No.: US 11,030,896 B2
(45) **Date of Patent: *Jun. 8, 2021**

(54) REAL-TIME TRAFFIC INFORMATION COLLECTION

(71) Applicant: Bitsensing Inc., Seoul (KR)

(72) Inventors: Jae Eun Lee, Seoul (KR); Sung Jin Lee, Seoul (KR)

(73) Assignee: Bitsensing Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/443,409

(22) Filed: Jun. 17, 2019

(65) Prior Publication Data

US 2020/0143673 A1 May 7, 2020

Related U.S. Application Data

(63) Continuation of application No. 15/949,894, filed on Apr. 10, 2018, now Pat. No. 10,373,490.

(60) Provisional application No. 62/483,843, filed on Apr. 10, 2017.

(51) Int. Cl.
*G08G 1/09* (2006.01)
*G08G 1/01* (2006.01)

(52) U.S. Cl.
CPC ..... *G08G 1/091* (2013.01); *G08G 1/0112* (2013.01); *G08G 1/0116* (2013.01); *G08G 1/0133* (2013.01); *G08G 1/0141* (2013.01)

(58) Field of Classification Search
CPC .... G08G 1/091; G08G 1/0116; G08G 1/0141; G08G 1/0129; G08G 1/0112; G08G 1/0133
See application file for complete search history.

(56) References Cited

U.S. PATENT DOCUMENTS

| | | | | |
|---|---|---|---|---|
| 9,349,287 | B1 * | 5/2016 | Holzwanger | G08G 1/0141 |
| 10,373,490 | B2 * | 8/2019 | Lee | G08G 1/091 |
| 2011/0054731 | A1 * | 3/2011 | DeRose | G06Q 10/08 701/31.4 |
| 2012/0306664 | A1 * | 12/2012 | Geter | G08G 1/166 340/903 |
| 2012/0307065 | A1 * | 12/2012 | Mimeault | G01S 17/04 348/149 |
| 2014/0229255 | A1 * | 8/2014 | Scofield | G06Q 30/0207 705/14.21 |
| 2014/0232564 | A1 * | 8/2014 | Garay | G08G 1/0129 340/934 |

(Continued)

*Primary Examiner* — Thomas D Alunkal
(74) *Attorney, Agent, or Firm* — Procopio, Cory, Hargreaves & Savitch LLP

(57) ABSTRACT

System, method, and non-transitory computer-readable storage medium, including: a sensor installed on a section of a road and configured to collect traffic data related to movements of vehicles on the section of the road, wherein the sensor samples the traffic data at a certain interval long enough to substantially reduce the amount of the collected traffic data; a plurality of narrowband network towers configured to relay the collected traffic data received from a plurality of sensors installed on a designated area encompassing multiple sections; and a central server configured to receive and process the collected traffic data from the plurality of narrowband network towers to generate traffic information sufficient to provide accurate real-time traffic information of the designated area.

20 Claims, 4 Drawing Sheets

(56) References Cited

U.S. PATENT DOCUMENTS

| | | | | |
|---|---|---|---|---|
| 2015/0065036 | A1* | 3/2015 | Srinivasan | H04W 4/029 455/41.1 |
| 2015/0066355 | A1* | 3/2015 | Siegel | G01C 21/3492 701/410 |
| 2017/0180480 | A1* | 6/2017 | Yang | H04L 12/185 |
| 2017/0287332 | A1* | 10/2017 | Ranninger Hernandez | B60W 30/09 |
| 2018/0181095 | A1* | 6/2018 | Funk | G05B 19/048 |

* cited by examiner

REAL-TIME TRAFFIC INFORMATION COLLECTION

CROSS-REFERENCE TO RELATED APPLICATIONS

The present application is a continuation application of co-pending U.S. patent application Ser. No. 15/949,894, filed Apr. 10, 2018, which claims the benefit of priority under 35 U.S.C. § 119(e) of U.S. Provisional Patent Application No. 62/483,843, filed Apr. 10, 2017, entitled "Traffic Radar System." The disclosures of the above-referenced applications are incorporated herein by reference.

BACKGROUND

Field of the Invention

The present disclosure relates to traffic information collection, and more specifically, to providing accurate real-time traffic information.

Background

Drivers obtain traffic conditions through electronic traffic status signs installed on the road, traffic radio stations, or electronic navigation guidance such as the global position system (GPS). Thus, the real-time traffic information enables the driver to save time and fuel. Further, the real-time traffic information can be linked with traffic signaling systems at intersections to reduce traffic congestions. Accordingly, the accurate real-time traffic information can provide not only time and fuel savings for individual drivers, but also reduce energy use and air pollution at the regional and national level. For autonomous vehicles, generating and providing large-scale, real-time traffic information at the regional and/or national level is important in establishing the route guidance, in addition to the basic autonomous operations of the vehicle. Currently, the traffic information collection is done using various different methods including a closed-circuit television (CCTV) method and a loop detector method.

For the CCTV method, the CCTV cameras can be installed on designated roads and the videos collected from the CCTVs are transmitted to a central server. The operators may divide the videos into local zones and visually confirm and input the real-time traffic conditions. However, the CCTV method requires a lot of manpower and labor costs to provide a city-wide or nationwide coverage of the real-time traffic information. Further, providing the real-time traffic information can be difficult because it requires continuous, real-time visual monitoring.

For the loop detector method, the loop coil sensors can be installed on roads to sense and collect the movement of vehicles on the road and to combine the movement with information from the location sensors installed in public transportation vehicles such as buses and taxis. Although this method may provide more accurate and automatic traffic volume measurement than the CCTV, the cost of installation and maintenance can be prohibitive. Further, transmitting the collected data from the loop detectors to the central server may require a high-speed network, which can be very expensive.

SUMMARY

The present disclosure describes a traffic information collection system which addresses issues with collecting real-time large scale traffic data.

In one implementation, a system is disclosed. The system includes: a sensor installed on a section of a road and configured to collect traffic data related to movements of vehicles on the section of the road, wherein the sensor samples the traffic data at a certain interval long enough to substantially reduce the amount of the collected traffic data; a plurality of narrowband network towers configured to relay the collected traffic data received from a plurality of sensors installed on a designated area encompassing multiple sections; and a central server configured to receive and process the collected traffic data from the plurality of narrowband network towers to generate traffic information sufficient to provide accurate real-time traffic information of the designated area.

In one implementation, the sensor includes a narrowband Internet-of-Things (IoT) sensor. In one implementation, the sensor is a radar sensor using radio frequency (RF) electromagnetic waves. In one implementation, the designated area is an entire city. In one implementation, the plurality of narrowband network towers is connected using a narrowband IoT network. In one implementation, the certain interval is between 1 and 10 minutes. In one implementation, the sensor includes an RF unit configured to transmit and receive electromagnetic waves onto the vehicles on the section of the road; a signal processing unit configured to process signals reflected from the vehicles; and a positioning unit configured to determine and indicate position information of the sensor. In one implementation, the positioning unit is a global positioning system (GPS) unit. In one implementation, the system further includes an encryption unit configured to provide data security for the collected traffic data of the sensor. In one implementation, the system further includes a plurality of communication units configured to enable the sensor to communicate with the plurality of narrowband network towers. In one implementation, the plurality of communication units includes a Wifi unit and an Ethernet unit configured to enable the sensor to communicate with a mobile device during initial alignment of the sensor. In one implementation, the signal processing unit is also configured to calculate, from the signals reflected from the vehicles, an arithmetic mean of speed of the vehicles.

In one implementation, a method is disclosed. The method includes: collecting traffic data related to movements of vehicles on a section of a road using a radar sensor installed on the section of the road, wherein the sensor samples the traffic data at a certain interval long enough to substantially reduce the amount of the collected traffic data; relaying the collected traffic data received from a plurality of radar sensors installed on a designated area encompassing multiple sections using a narrowband network; and receiving and processing the collected traffic data from the narrowband network to generate traffic information sufficient to provide accurate real-time traffic information of the designated area.

In one implementation, the narrowband network includes a narrowband Internet-of-Things (IoT) network. In one implementation, the designated area is an entire city. In one implementation, the certain interval is between 1 and 10 minutes. In one implementation, the method further includes transmitting and receiving electromagnetic waves onto the vehicles on the section of the road; and processing signals reflected from the vehicles. In one implementation, the method further includes providing data security for the collected traffic data of the radar sensor. In one implementation, the method further includes enabling the radar sensor to communicate with a mobile device during initial alignment of the radar sensor.

In one implementation, a non-transitory computer-readable storage medium storing a computer program to collect traffic information is disclosed. The computer program includes executable instructions that cause a computer to: collect traffic data related to movements of vehicles on a section of a road using a radar sensor installed on the section of the road, wherein the sensor samples the traffic data at a certain interval long enough to substantially reduce the amount of the collected traffic data; relay the collected traffic data received from a plurality of radar sensors installed on a designated area encompassing multiple sections using a narrowband network; and receive and process the collected traffic data from the narrowband network to generate traffic information sufficient to provide accurate real-time traffic information of the designated area.

Other features and advantages of the present disclosure should be apparent from the present description which illustrates, by way of example, aspects of the present disclosure.

BRIEF DESCRIPTION OF THE DRAWINGS

The details of the present disclosure, both as to its structure and operation, may be gleaned in part by study of the appended drawings, in which like reference numerals refer to like parts, and in which.

DETAILED DESCRIPTION

Figure 1:
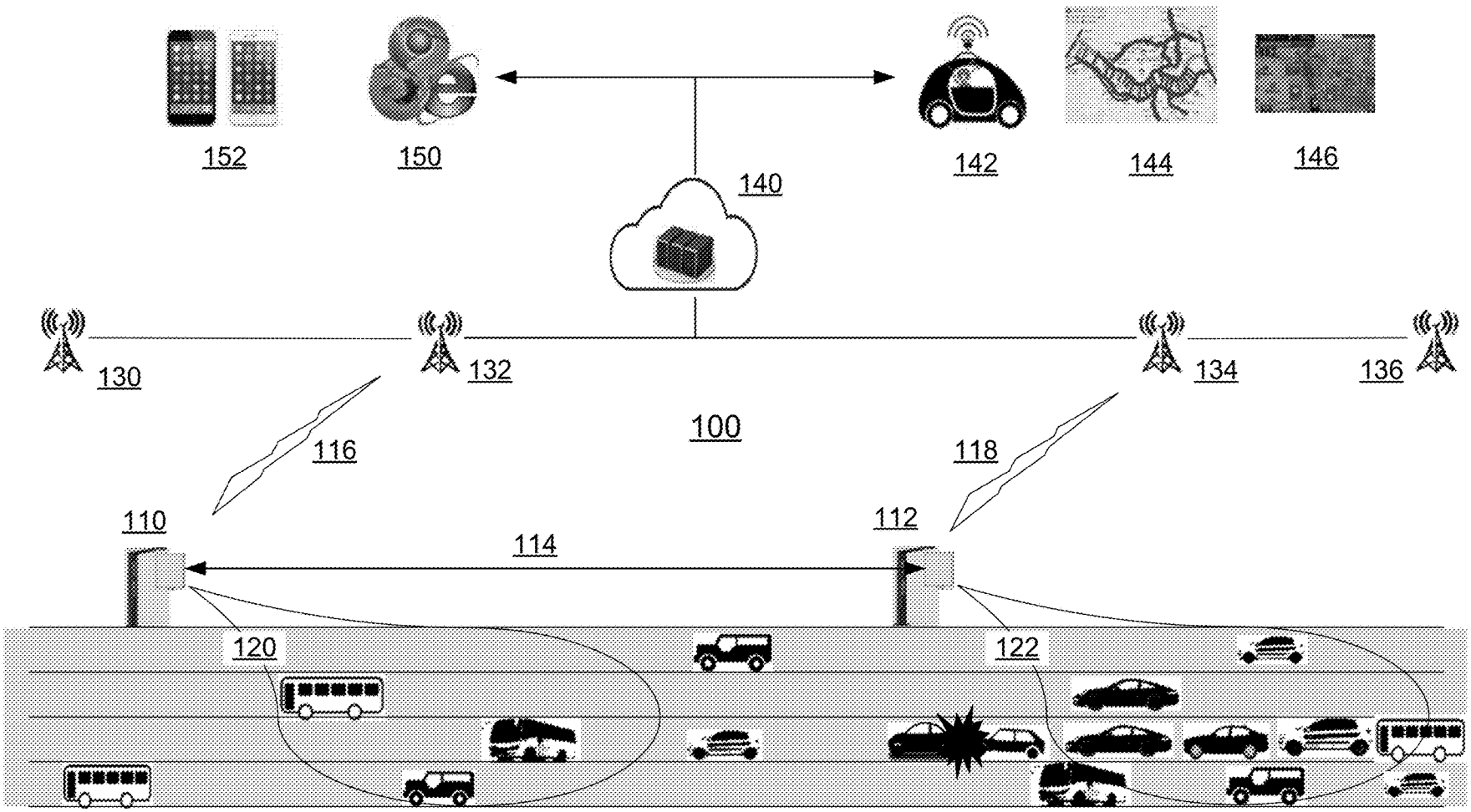
FIG. 1 is a diagram of a traffic data collection system in accordance with one implementation of the present disclosure.

As stated above, although the traffic information collection can be done using various different methods including the CCTV method and the loop detector method, the CCTV method requires a lot of manpower and labor costs, while installation, maintenance, and transmission of the collected data for the loop detector method can be prohibitive and may require an expensive high-speed network.

Certain implementations of the present disclosure provide for collecting traffic information by using multiple radar (or Light Detection and Ranging (Lidar)) sensors that substantially reduce the requirement for peripheral equipment needed for installation and information collection. This substantially reduces investment and communication costs. The present disclosure can also provide the collected traffic information to general users, traffic broadcasting stations, road management-related agencies, and/or navigation service providers. Further, the present disclosure provides for transmitting the collected traffic data to a central server using low-power narrowband networks such as the Narrowband Internet of Things (IoT) network or the Low Power Wide Area Network (LPWAN). However, to use the low-power narrowband network to transmit the collected data, the traffic data needs to be processed so that only the essential parts of the traffic data can be transmitted.

After reading these descriptions, it will become apparent how to implement the disclosure in various implementations and applications. However, although various implementations of the present disclosure will be described herein, it is to be understood that these implementations are presented by way of example only, and not limitation. As such, this detailed description of various implementations should not be construed to limit the scope or breadth of the present disclosure.

In one implementation, the collected traffic data is processed over a predetermined period of time and transmitted to the central server over a narrowband network such as the IoT network. Thus, to be able to do this, the collected traffic data is processed over time into a reduced size of essential data. Since the IoT network itself is an existing wireless network, there is no need for installing separate communication network and network equipment. Further, since the sensor can be programmed to collect certain data at the predetermined interval, the sensor does not need a separate computer for collecting data, which substantially reduces the operating cost.

In one implementation, the sensors (e.g., radar sensors) are placed at certain points (e.g., intersections) on the road to continuously collect and store the movement, the speed, and the size of objects (e.g., vehicles) within certain sections of the road. In one implementation, the traffic data for a particular section is collected over a predetermined period of time and is processed to calculate information necessary to determine the traffic condition such as the arithmetic mean of the speed of the vehicles, the maximum speed, the sizes of the passing vehicles, of the particular section. The processed traffic data of the particular section is then transmitted over the narrowband network from the sensor to the central server.

In one implementation, the central server processes the traffic data transmitted from selected sensors within a desired area (e.g., city wide) to create large-scale traffic information of the desired area. This large-scale traffic information can be provided to the organizations managing the traffic conditions of the desired area, navigation service providers, or general users. In one implementation, the large-scale traffic information is used as operating schedule information of autonomous vehicles.

In one implementation, given the above-stated requirements of the sensors, the sensors (e.g., radar or Lidar sensors) can be mass produced into about the size of mobile phones and easily installed on existing street light posts, traffic light posts, and/or speed camera mounts, to significantly reduce the cost of installing the sensors. Further, the cost of the sensors can be significantly reduced by removing the need to have controller computers, but having an on-chip processor and a storage unit (e.g., small-sized storage) attached to the radar or Lidar transmitters and receivers. In one implementation, the on-chip processor can adjust the time interval between arithmetic averaging of the vehicle speed with respect to an intersection, bottleneck section/lanes of the road, or carpool lanes. The traffic data collected by the sensor can provide traffic condition of each lane of the road so that accurate traffic data can be analyzed by the central server. Further, the processing at the central server (or at the sensor) can also include object identifications to estimate the flow of the object. For example, a semi-truck with multiple trailers can be identified so that when the semi-truck is in an accident, the central server can determine why there would be slow down on multiple lanes of the road.

FIG. 1 is a diagram of a traffic data collection system 100 in accordance with one implementation of the present disclosure. In the illustrated implementation of FIG. 1, the traffic data collection system 100 includes a plurality of sensors 110, 112, a plurality of narrowband network towers 130, 132, 134, 136, and a central server 140.

The plurality of sensors 110, 112 is installed on existing street light posts, traffic light posts, speed camera mounts, and/or newly-built posts on the road. In one implementation, the sensors are IoT sensors. In one implementation, the sensors are radar sensors. In another implementation, the sensors are Lidar sensors.

In one implementation, the sensors 110, 112 installed on the posts or mounts are placed at certain points (e.g., intersections) on the road and are certain distances apart from each other so that different sections 120, 122 of the road can be covered by the sensors 110, 112. In one implementation, the distance 114 between the sensors 110, 112 is approximately 200 to 500 meters.

In FIG. 1, each sensor 110, 112 senses objects (e.g., vehicles) inside a section 120, 122 by radiating electromagnetic waves (in the case of a radar sensor). Using the reflected signal, the distance, the speed, and the angle (with respect to the line from the sensor to the object) can be sensed and determined. In one implementation, the radar sensor can detect the speed and the direction of the object using the Doppler effect. Further, using multiple receiving channels of the radar sensor and a triangulation method, objects (e.g., vehicles) moving in each lane can be determined.

In one implementation, all collected data such as velocity, position, and size of the observed objects are stored in the storage unit of the sensor. However, only the data sufficient to determine the large-scale traffic information such as the velocity of the objects is transmitted to the central server 140 via the plurality of narrowband network towers 130, 132, 134, 136. In one implementation, the transmission distances 116, 118 from the sensors 110, 112 to the narrowband network towers 130, 132, 134, 136 are approximately 1 to 10 km, with the maximum distance being approximately 12 km.

In one implementation, the velocities of the objects are collected at a certain time interval (e.g., every 2 minutes) that is sufficient to determine the large-scale traffic information at the central server 140. Thus, the time interval can be adjusted depending on the factors such as time of day, determination that an accident has occurred, and/or needs of the central server 140. For example, in the case of a city section where the vehicles must stop at a pedestrian crossing, the cumulative arithmetic average speed over several minutes rather than the real-time vehicle speed in seconds can provide more accurate information for determining the actual traffic flow of the city section.

In another example of a busy intersection, the approximate average speed is about 20 to 30 km/h including the signal waiting time. Thus, in this example, it may be sufficient to collect the vehicle speed for about 5 to 10 minutes and to perform the arithmetic averaging of the collected speeds. For low-traffic or wide-area roads (highways, national roads, motorway, etc.), most vehicle speeds are around 70 to 100 km/h, which is close to the speed limit. On these roads, there may not be any difference between the cumulative arithmetic average speed measured over minutes and the real time traffic speed. In case of an accident, the speed of the lane on which the accident occurred may change rapidly. However, since the lanes surrounding the accident lane may gradually become stagnant, the average vehicle speed data per minute can provide sufficient traffic information. Further, in some implementations, more accurate traffic information can be determined by analyzing the maximum speed and the number of vehicles crossing the road in a given time.

In one implementation, the central server 140 performs real-time processing and analysis of the collected data to produce large-scale traffic information. This large-scale traffic information can be provided to the organizations 144 managing the traffic conditions of the desired area, navigation service providers 146, or general users through the web service 150 or the mobile service 152. In one implementation, the large-scale traffic information is used as operating schedule information of autonomous vehicles 142.

In one implementation, as stated above, the traffic data collected by the radar sensors 110, 112 deployed on the road is transmitted to the central server 140 through the narrowband public network (e.g., IoT network) including towers 130, 132, 134, 136. In the central server 140, the position information of each radar sensor 110, 112 and the transmitted data are stored on the storage unit. The average speed (calculated by sensors within a particular section) measured at a certain time interval is used to determine the traffic information for the particular section. The sensor 110, 112 may require a power supply or other alternative power source (e.g., a battery or solar power unit). In some implementations, the sensors 110, 112 can be operated in a power-saving mode such that the sensors 110, 112 only operate when the movement is detected. Otherwise, the sensors 110, 112 are kept in a standby mode. Further, the sensors 110, 112 can be controlled by the central server 140 so that both the sensors and the server operate in different modes depending on the weather, the time of day, the day of the week, and holidays.

Figure 2:
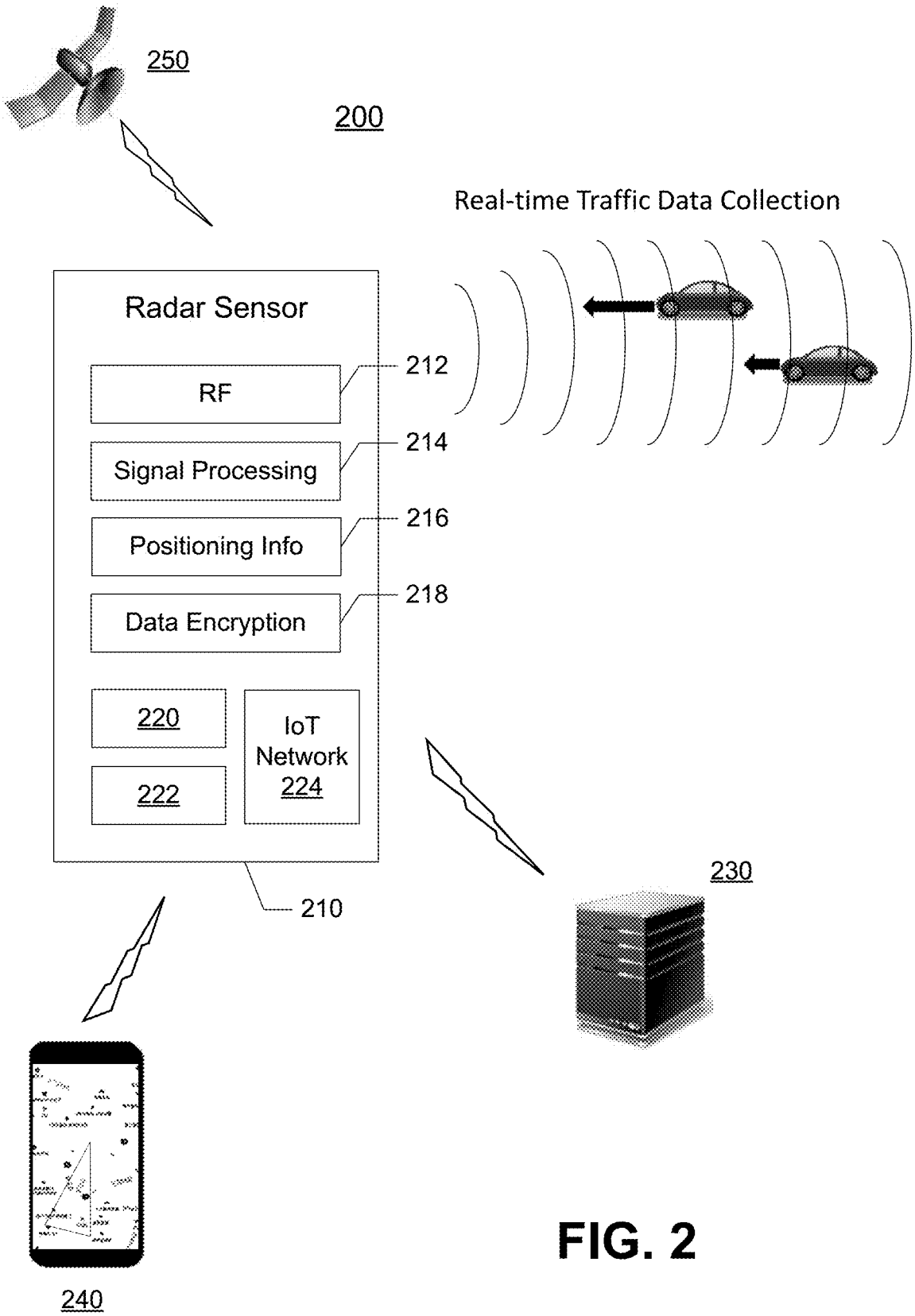
FIG. 2 is an interface diagram illustrating interface between the sensor and other elements of the traffic data collection system in accordance with one implementation of the present disclosure.

FIG. 2 is an interface diagram 200 illustrating interface between the sensor 210 and other elements of the traffic data collection system 100 in accordance with one implementation of the present disclosure. The illustrated implementation of FIG. 2 shows the sensor 210 interfacing with the central server 230, a mobile device 240 which may be used to individually control and program the sensor 210, and a satellite unit 250 which may be used when land-based networks are down.

In one implementation, the sensor 210 (e.g., the radar sensor) includes an RF unit 212, a signal processing unit 214, a positioning unit 216, an encryption unit 218, and various communication units 220, 222, 224. The RF unit 212 is configured to transmit and receive electromagnetic waves. The signal processing unit 214 is configured to process signals reflected from the vehicles. The positioning unit 216 is configured to determine and indicate the position information of the sensor 210. In one implementation, the positioning unit 216 is a global positioning system (GPS) unit. The encryption unit 218 is configured to provide data security. In one implementation, the communication units include a Wifi unit 220, an Ethernet unit 222, and an IoT network communication unit 224. The Ethernet unit 222 can be used to perform initial alignment of the position and direction of the sensor 210 during installation. The IoT network communication unit 224 can be used to transmit the collected traffic data to the central server 230 at a predetermined interval.

In one implementation, the Wifi unit 220 can be used during the installation of the sensor 210 to calibrate the mapping and collection of data using, for example, the mobile device 240. Thus, the mobile device 240 can install the map application and during the sensor installation process, the position of the sensor 210 from the positioning unit 216 is obtained, transmitted to the mobile device 240 using the Ethernet or Wifi unit and displayed on the map application. The collected traffic data can then be displayed on the map application using the position information of the sensor 210. Accordingly, the initialization of the sensor 210 can be done using the mobile device 240 using the position information of the sensor, the collected traffic data of the section of the road, and the map application. Further adjustment can be made simple by calculating the curvature and the shape of the road and tracking the position of the stationary object or the path of the moving object at the position where the radar is installed.

In one implementation, the sensor 210 can also be equipped with a 6-axis or 9-axis motion detector (not shown) so that a precise and accurate initialization of the sensor 210 can be performed. The installed sensor 210 can transmit the collected traffic data to the central server 230 through the IoT network. The central server 230 can store the traffic data (e.g., average speed, maximum speed, number of traffic vehicles, etc.) along with the position information of the sensors received from the sensors. The data received from the sensors and stored on the storage unit of the central server 230 forms large-scale real-time traffic information. In one implementation, the processing of the large-scale real-time traffic information can include an artificial intelligence method using machine learning or deep learning. The traffic information can be combined with information about the section being monitored, the weather, the day of the week, the holiday, and/or other similar factors (e.g., constructions or special events going on in the section, etc.) to accurately predict and estimate the travel time and recommend best route to take.

In some implementations, traffic lights on the same section of the road (as the section being monitored for traffic) can be communicated to the central server 230 so that the traffic signal information can also be combined with the above-enumerated information to provide accurate traffic information and route guidance. In other implementations, data from the CCTV cameras can be added to the traffic data of the sensors to provide additional information.

In one implementation, the signal processing unit 214 is arranged such that at least one observation point in the real-time object movement interval coincides with a specific physical position on the road, and the intensity of the electromagnetic wave reflected by the vehicle passes through the specific physical position. The mean values for at least one of the vehicle classification information, the number of vehicles, the vehicle speed, the distance between the vehicles, the vehicle traveling direction, and/or the lane information can then be used to calculate the arithmetic mean which is transmitted to the central server at a predetermined interval.

Figure 3:
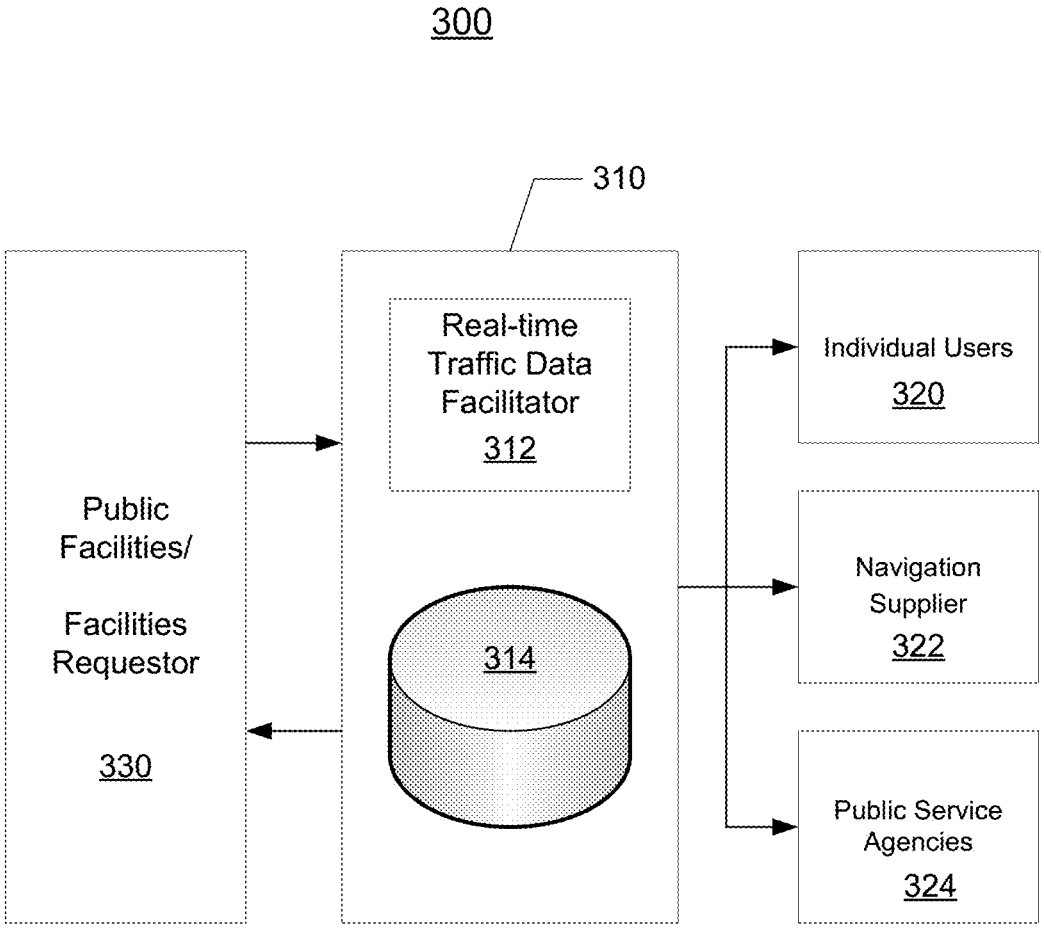
FIG. 3 is a block diagram of a system for utilizing the traffic information generated by an entity in accordance with one implementation of the present disclosure.

FIG. 3 is a block diagram of a system 300 for utilizing the traffic information generated by an entity 310 in accordance with one implementation of the present disclosure. In the illustrated implementation of FIG. 3, the entity 310 (similar to the central server 230 in FIG. 2) includes a real-time traffic data facilitator 312 and a 'big data' storage unit 314.

In one implementation, the real-time traffic data facilitator 312 receives the collected traffic data from multiple sensors (e.g., from thousands to millions of sensors) and stores the received data in the 'big data' storage unit 314. The real-time traffic data facilitator 312 can process and combine the stored data into usable traffic information which can be commoditized and/or monetized. In one implementation, the traffic information generated by the real-time traffic data facilitator 312 can be sold directly to the individual users 320, the navigation suppliers 322, and/or the public service agencies 324, or supplied to them using an advertising model. The real-time traffic information can be shared with public facilities 330 in return for permitting the installation of the sensors in public places.

In one implementation, the payment for traffic information can be made through an account setup using a subscription step and a login step, which provides access to the storage unit 314. The rate charged by the entity 310 can be made different depending on the frequency of usage after the subscription step or subsequent data usage in retrieving traffic information data, downloading it to the memory of the user, and further processing the traffic information so that the information can be used in the business of the user. In another implementation, the rate charged by the entity 310 can be substantially reduced or eliminated by accepting advertisement from a specific advertiser so that the rate is paid by the advertiser.

Figure 4:
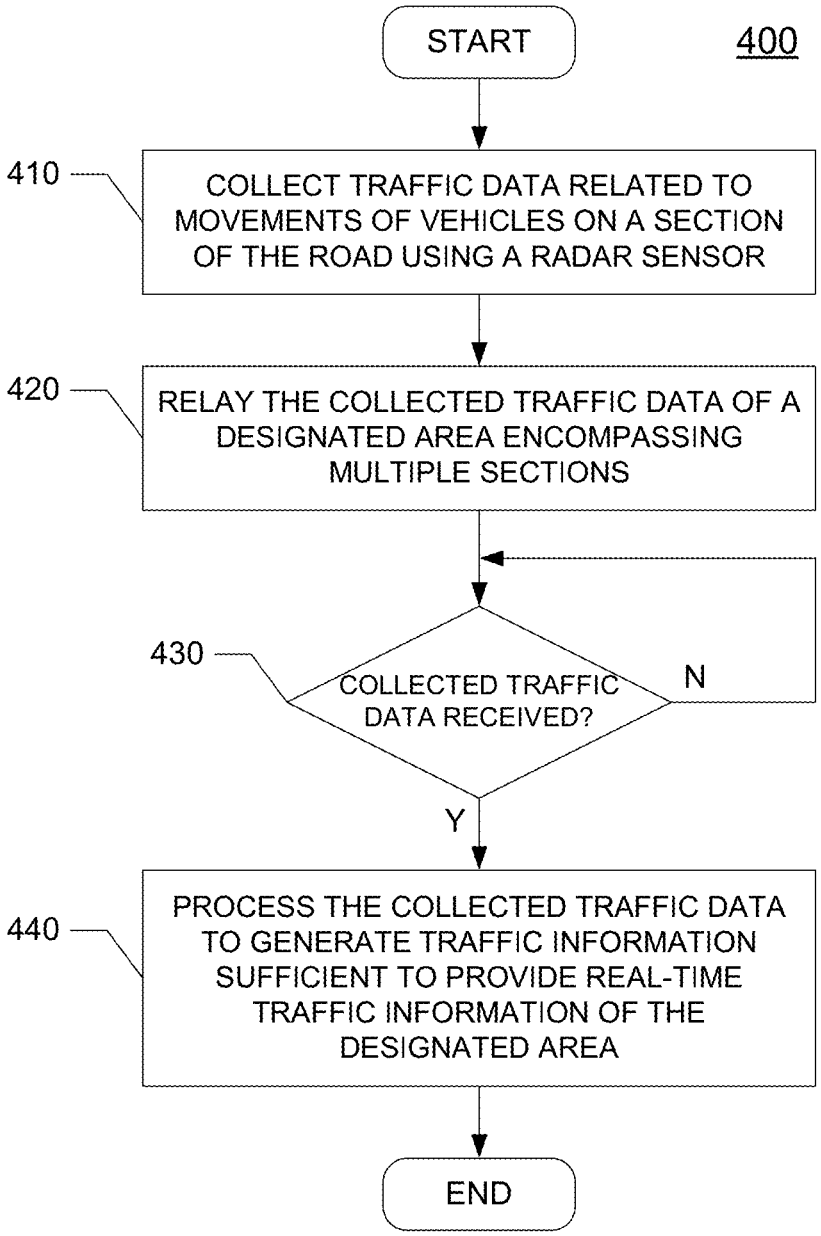
FIG. 4 is a flow diagram of a process for linking a media consumption history to a consumer using a blockchain-based media ledger in accordance with one implementation of the present disclosure.

FIG. 4 is a flow diagram of a process 400 for collecting traffic data related to movements of vehicles on a section of a road in accordance with one implementation of the present disclosure.

In the illustrated implementation of FIG. 4, the process includes collecting traffic data related to movements of vehicles on a section of a road, at step 410, using a radar sensor installed on the section of the road. In one implementation, the radar sensor samples the traffic data at a certain interval long enough to substantially reduce the amount of the collected traffic data. The collected traffic data of a designated area encompassing multiple sections is then relayed, at step 420, using a narrowband network. A determination is made, at step 430, whether the collected traffic data has been received. If the collected traffic data has been received from the narrowband network, the traffic data is processed, at step 440, to generate traffic information sufficient to provide accurate real-time traffic information of the designated area.

In one implementation, the narrowband network includes a narrowband Internet-of-Things (IoT) network. In one implementation, the designated area is an entire city. In one implementation, the certain interval is between 1 and 10 minutes. In one implementation, the process 400 further includes transmitting and receiving electromagnetic waves onto the vehicles on the section of the road and processing the signals reflected from the vehicles. In one implementation, the process 400 further includes providing data security for the collected traffic data of the radar sensor. In one implementation, the process 400 further includes enabling the radar sensor to communicate with a mobile device during initial alignment of the radar sensor.

The above description of the disclosed implementations is provided to enable any person skilled in the art to make or use the invention as described in the specification presented above. Various modifications to these implementations will be readily apparent to those skilled in the art, and the generic principles described herein can be applied to other implementations without departing from the spirit or scope of the disclosure. Although the above descriptions mention using the traffic data for navigation and/or autonomous driving, other uses for the collected traffic data are contemplated. For example, the collected traffic data can be used for city planning, determination of suitable locations for airport, etc. Further, although the sensor is described as sensing vehicles on the road, other objects or being can be sensed such as humans or animals. Accordingly, the techniques are not limited to the specific examples described above. Thus, it is to be understood that the description and drawings presented herein represent a presently possible implementation of the disclosure and are therefore representative of the subject matter that is broadly contemplated by the present disclosure. It is further to be understood that the scope of the present disclosure fully encompasses other implementations that may become obvious to those skilled in the art and that the scope of the present disclosure is accordingly limited by nothing other than the appended claims.

The invention claimed is:

1. A system comprising:

at least one sensor installed on a section of a road and configured to collect traffic data related to movements of vehicles on the section of the road, wherein the at least one sensor samples the traffic data at a certain interval long enough to substantially reduce the amount of the collected traffic data, and processes the traffic data over time to include only essential data including an arithmetic mean of speed of the vehicles, maximum speed, sizes of the vehicles on the section of the road, wherein each of the at least one sensor: (a) radiates radio frequency (RF) electromagnetic waves directed at the section of the road; (b) senses signals reflected by the vehicles on the section of the road; and (c) determines and collects the traffic data including distance, speed, and angle of the vehicles on the section of the road;

a plurality of traffic data relay devices configured to relay the collected traffic data received from a plurality of sensors installed on a designated area encompassing multiple sections, wherein the plurality of traffic data relay devices comprises low-power network devices to enable the at least one sensor to (1) operate in a power saving mode powered by a stand-alone power source and (2) transmit the substantially reduced amount of the collected traffic data; and a central server configured to receive and process the collected traffic data from the plurality of traffic data relay device to generate traffic information sufficient to provide accurate real-time traffic information of the designated area.

2. The system of claim 1, wherein each of the at least one sensor comprises an RF unit configured to transmit and receive electromagnetic waves onto the vehicles on the section of the road;

a signal processing unit configured to process signals reflected from the vehicles; and a positioning unit configured to determine and indicate position information of the sensor.

3. The system of claim 1, wherein each of the at least one sensor is a radar.

4. The system of claim 1, wherein each of the at least one sensor is a light detection and ranging (Lidar) device.

5. The system of claim 1, wherein the plurality of traffic data relay devices comprises a low power wide area network device (WAN).

6. The system of claim 5, wherein the WAN includes a cellular data network.

7. The system of claim 6, wherein the cellular data network includes 5G long-term evolution (LTE) network.

8. The system of claim 1, wherein the at least one sensor is placed at an intersection of the road to continuously collect and store movement, speed, and size of the vehicles.

9. The system of claim 8, wherein the at least one sensor is configured to be about the size of a mobile phone and attached to an existing street light at the intersection of the road.

10. A traffic data collection method comprising:

collecting traffic data related to movements of vehicles on a section of the road using at least one sensor installed on the section of a road, wherein said collecting the traffic data includes sampling the traffic data at a certain interval long enough to substantially reduce the amount of the collected traffic data using the at least one sensor by: (a) radiating RF electromagnetic waves directed at the section of the road; (b) sensing signals reflected by the vehicles on the section of the road; and (c) determining and collecting the traffic data including distance, speed, and angle of the vehicles on the section of the road, wherein said collecting also includes processing the traffic data over time to include only essential data including an arithmetic mean of speed of the vehicles, maximum speed, sizes of the vehicles on the section of the road;

relaying the collected traffic data received at the at least one sensor using a plurality of traffic data relay devices, wherein the plurality of traffic data relay devices comprises low-power network devices to enable the at least one sensor to (1) operate in a power saving mode powered by a stand-alone power source and (2) transmit the substantially reduced amount of the collected traffic data.

11. The method of claim 10, further comprising enabling each of the at least one sensor to communicate with a mobile device during initial alignment of each of the at least one sensor.

12. The method of claim 10, further comprising placing the at least one sensor at an intersection of the road to continuously collect and store movement, speed, and size of the vehicles.

13. The method of claim 12, further comprising producing the at least one sensor to be about the size of a mobile phone and attached to existing street light posts or traffic light posts at the intersection of the road.

14. The method of claim 10, wherein each of the at least one sensor is a radar.

15. The method of claim 10, further comprising determining the vehicles moving each lane of the section of the road using multiple receiving channels of the at least one sensor and a triangulation method.

16. The method of claim 10, wherein the traffic data is sampled at a certain interval long enough to substantially reduce the amount of the collected traffic data.

17. The method of claim 10, further comprising receiving and processing the collected traffic data at a central server from the plurality of traffic data relay devices to generate traffic information sufficient to provide accurate real-time traffic information of the designated area.

18. The method of claim 17, wherein the traffic data is sampled at a certain interval that is sufficient to determine large-scale traffic information at the central server.

19. A non-transitory computer-readable storage medium storing a computer program to collect traffic information, the computer program comprising executable instructions that cause a computer to:

collect traffic data related to movements of vehicles on a section of the road at a certain interval long enough to substantially reduce the amount of the collected traffic data using at least one sensor installed on the section of a road, wherein the executable instructions that cause the computer to collect the traffic data includes executable instructions that cause the computer to sample the traffic data using the at least one sensor by: (a) radiating RF electromagnetic waves directed at the section of the road; (b) sensing signals reflected by the vehicles on the section of the road; and (c) determining and collecting the traffic data including distance, speed, and angle of the vehicles on the section of the road, wherein the executable instructions that cause the computer to collect the traffic data also includes executable instructions that cause the computer to process the traffic data over time to include only essential data including an arithmetic mean of speed of the vehicles, maximum speed, sizes of the vehicles on the section of the road;

relay the collected traffic data received at the at least one sensor using a plurality of traffic data relay devices, wherein the plurality of traffic data relay devices comprises low-power network devices to enable the at least one sensor to (1) operate in a power saving mode powered by a stand-alone power source and (2) transmit the substantially reduced amount of the collected traffic data.

20. The non-transitory computer-readable storage medium of claim 19, wherein the traffic data is sampled at a certain interval long enough to substantially reduce the amount of the collected traffic data.

* * * * *